US011555681B2

(12) United States Patent
Pereira et al.

(10) Patent No.: US 11,555,681 B2
(45) Date of Patent: Jan. 17, 2023

(54) BLASTING TECHNIQUE

(71) Applicant: ORICA INTERNATIONAL PTE LTD, Singapore (SG)

(72) Inventors: Nigel Brett Pereira, Paterson (AU); Les Willan, Mackay (AU); Murali Nagarajan, Maitland (AU); Carlos Vicente Arana Quijano, Aberglasslyn (AU); Stephen Jeric, Subiaco (AU)

(73) Assignee: ORICA INTERNATIONAL PTE LTD, Singapore (SG)

( * ) Notice: Subject to any disclaimer, the term of this patent is extended or adjusted under 35 U.S.C. 154(b) by 0 days.

(21) Appl. No.: 17/048,375

(22) PCT Filed: Apr. 17, 2019

(86) PCT No.: PCT/SG2019/050217
§ 371 (c)(1),
(2) Date: Oct. 16, 2020

(87) PCT Pub. No.: WO2019/203731
PCT Pub. Date: Oct. 24, 2019

(65) Prior Publication Data

US 2021/0102793 A1 Apr. 8, 2021

(30) Foreign Application Priority Data

Apr. 19, 2018 (SG) ..... 10201803282U

(51) Int. Cl.
*F42D 3/04* (2006.01)
*E21C 41/28* (2006.01)
(Continued)

(52) U.S. Cl.
CPC ..... *F42D 3/04* (2013.01); *E21C 41/28* (2013.01); *F42D 1/08* (2013.01); *E21B 7/025* (2013.01); *F42D 1/055* (2013.01)

(58) Field of Classification Search
CPC . E21C 41/28; E21C 41/26; F42D 1/00; F42D 1/045; F42D 1/05; F42D 1/055;
(Continued)

(56) References Cited

U.S. PATENT DOCUMENTS 4,135,450 A * 1/1979 Lang ..... E21B 43/263 102/301
4,262,965 A * 4/1981 Ricketts ..... E21C 41/24 102/301
(Continued)

FOREIGN PATENT DOCUMENTS

AU 511684 B2 * 8/1980 ..... E21D 1/03
CN 107328327 7/2017
(Continued)

OTHER PUBLICATIONS

International Search Report and Written Opinion for PCT/SG2019/050217 dated Jul. 8, 2019.
(Continued)

*Primary Examiner* — Abby J Flynn
*Assistant Examiner* — Michael A Goodwin
(74) *Attorney, Agent, or Firm* — Barnes & Thornburg LLP

(57) ABSTRACT

A method of mining in a rock formation, includes drilling blastholes extending into the rock formation. Each of the blastholes has a depth between a first end and a second end. For each blasthole the second end thereof is deeper into the rock formation than the first end thereof. The method further
(Continued)

includes loading the blastholes with alternating layers of explosives charges and stemming material to establish a succession of blasting decks or sections extending across and within the rock formation. The rock formation includes at least a first blasting deck or section and a second blasting deck or section.

8 Claims, 5 Drawing Sheets

(51) Int. Cl.
*F42D 1/08* (2006.01)
*E21B 7/02* (2006.01)
*F42D 1/055* (2006.01)

(58) Field of Classification Search
CPC ..... F42D 1/06; F42D 1/08; F42D 1/18; F42D 1/22; F42D 3/04; E21B 7/025
USPC ..... 102/311, 301, 313
See application file for complete search history.

(56) References Cited

U.S. PATENT DOCUMENTS 4,349,227 A * 9/1982 Langford ..... E21C 41/24 102/311
2003/0019383 A1* 1/2003 Yoon ..... F42D 3/04 102/312
2007/0272110 A1* 11/2007 Brent ..... F42D 3/04 102/313
2010/0212527 A1* 8/2010 McCaan ..... F42D 1/05 102/215
2012/0242135 A1 9/2012 Thomson
2016/0146588 A1* 5/2016 Thomson ..... F42B 3/10 102/313

FOREIGN PATENT DOCUMENTS

MX 2006005935 A 7/2006
MX 2012003611 A 4/2012
WO 2010085837 A1 8/2010
WO 2015143501 A1 10/2015
WO 2015143502 A1 10/2015

OTHER PUBLICATIONS

English translation of Peruvian Office Action for Peruvian Patent App. No. PE20201609A dated Jan. 19, 2022, 16 pages.
English translation of Publicatión: «Diseñño de voladura en cráter aplicando nuevo modelo matemático» (Rene W. Ojeda Mestas) publicado en el 2010, https://www.monografias.com/trabajos-pdf4/diseno-voladura-crater-aplicando-nuevo-modelo-matematico/diseno-voladura-crater-aplicando-nuevo-modelo-matematico, 52 pages.
Publicación: «Diseño de voladura en cráter aplicando nuevo modelo matemático» (Rene W. Ojeda Mestas) publicado en el 2010, https://www.monografias.com/trabajos-pdf4/diseno-voladura-crater-aplicando-nuevo-modelo-matematico/diseno-voladura-crater-aplicando-nuevo-modelo-matematico, 13 pages, (No English Translation available).
Orica, "Going Wireless", published Oct. 17, 2017, available at https://www.orica.com/ArticleDocuments/2202/AMM_1710_Drill-and-Blast_Wireless%20Editorial%20and%20Ad.pdf.aspx?Embed=Y, 4 pages.
Peruvian Office Action for Peruvian Patent App. No. PE20201609A dated Jan. 19, 2022, 11 pages, (No English Translation Available).

* cited by examiner

BLASTING TECHNIQUE

CROSS REFERENCE TO RELATED APPLICATIONS

This application is a U.S. national stage application under 35 U.S.C. § 371(b) of International Application No. PCT/SG2019/050217 filed Apr. 17, 2019, which claims priority to Singapore Patent Application No. 10201803282U filed on Apr. 19, 2018, the disclosures of both of which are hereby expressly incorporated by reference in their entirety.

TECHNICAL FIELD

The present invention relates to a method of mining, and in particular to an open cut mining method that involves blasting successive layers of rock in order to access recoverable material such as coal.

BACKGROUND

Conventional practice in open cut mining operations generally involves an independent cycle of drilling, explosives loading and blasting per each layer of rock to be broken. In each cycle, blastholes corresponding to a given layer of rock to be broken are drilled to take explosives. The blastholes are then loaded with explosives, and blasted by firing the explosives using an initiation system. Broken rock produced by the blast is removed and processed to recover materials of value (e.g., coal) or store materials as waste. Thus, rock is blasted in single layers on a bench-by-bench basis, and once one bench of rock has been drilled, loaded, blasted and excavated, the next bench below is prepared and the cycle continues.

This conventional approach has limitations and disadvantages associated with it. The loading of explosives into blastholes is a manual process requiring personnel to work in the field for many hours at a time. The process is equipment and labour intensive, which brings with it possible safety issues.

Furthermore, to maximize efficiency of the mining operation different processes of the cycle are typically undertaken at different areas of the same mine site. For example, blastholes in one area of the mine site may be drilled and loaded with explosives, while in another (independent) area broken rock produced by an earlier blast may be removed in preparation for another cycle of drilling etc. In this way, different processes of the overall cycle can be conducted independently and simultaneously. This is good for productivity, but requires large areas of real estate for safe implementation.

The present invention seeks to provide a new approach to open cut mining that provides advantages (e.g., productivity and/or safety benefits) when compared with the conventional approach discussed.

SUMMARY

In an embodiment, the present invention provides a technique or method of mining in a rock formation, which comprises:

In a single blasthole or borehole drilling and loading event or sequence:

drilling blastholes extending into the rock formation, each of the blastholes having a top end, a bottom end, and a length or depth extending therebetween;

loading these blastholes (e.g., to or approximately to their drilled lengths or depths) with multiple layers of explosives charges separated by inert stemming to produce alternating layers of explosives charges and inert stemming (e.g., such that successive layers of explosives charges are separated by an inert stemming layer containing one or more types of stemming material), and to provide a series of blasting decks (e.g., where each blasting deck corresponds to a particular layer of explosives charges) extending across and within the rock formation;

and subsequently:

selectively initiating or firing the explosives charges in a series of firing stages based on blasting deck, proceeding consecutively from the blasting deck located at the top of the blastholes to the blasting deck located at the bottom of the blastholes, wherein after each firing stage excavation takes place to progress mining in an intended direction, e.g., to a next deeper layer or level of material within the rock formation.

In accordance with an aspect of the present disclosure, a technique or method of mining in a rock formation includes: drilling blastholes extending into the rock formation, each of the blastholes having a depth between a first end and a second end, wherein for each blasthole the second end thereof is deeper into the rock formation than the first end thereof; loading the blastholes with alternating layers of explosives charges and stemming material to establish a succession of blasting decks or sections extending across and within the rock formation including a first blasting deck or section and at least a second blasting deck or section, wherein each blasting deck or section beyond the first blasting deck or section extends deeper into the rock formation than the first blasting deck or section; and after establishing the multiple blasting decks or sections extending across and within the rock formation, selectively initiating the explosives charges in a series of stages based on blasting deck or section proceeding consecutively from the first blasting deck or section to each successive blasting deck or section, wherein during initiating the explosives charges in a given blasting deck or section, the explosive charges in each deck or section successive to the given blasting deck or section are slept, and wherein after each stage excavation takes place to progress mining in an intended direction.

The explosives charges in each blasting deck or section include a set of explosive formulations and a set of selectively controllable initiation devices that can initiate the set of explosive formulations in the blasting deck or section.

In several embodiments, the set of initiation devices in each blasting deck or section is a set of wireless initiation devices. In some embodiments, the set of initiation devices in each blasting deck or section other than the first blasting deck or section is a set of wireless initiation devices, e.g., such that the set of initiation devices in the first blasting deck or section can include wired or wire-based initiation devices.

In some embodiments, excavation corresponding to at least one stage comprises retaining a portion of broken rock produced following the initiation of a given blasting deck to arrange the portion of broken rock over a next successive blasting deck to provide a false floor above the next successive blasting deck.

In multiple embodiments, the succession of blasting sections includes a plurality of blasting sections that are separated from each other by a portion of a mineral deposit, seam, or vein.

The blastholes extending across and within the succession of blasting sections can intercept and extend through at least one mineral deposit, seam, or vein, wherein within each blasthole stemming material is disposed on opposite sides of each mineral deposit, seam, or vein that each blasthole intercepts, thereby separating the mineral deposit, seam, or vein from direct contact with the explosives charges in the blasthole.

Each mineral seam can include or be a coal seam.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

Herein, reference to one or more embodiments, e.g., as various embodiments, many embodiments, several embodiments, multiple embodiments, some embodiments, certain embodiments, particular embodiments, specific embodiments, or a number of embodiments, need not or does not mean or imply all embodiments.

The reference in this specification to any prior publication (or information derived from it), or to any matter which is known, is not, and should not be taken as an acknowledgment or admission or any form of suggestion that prior publication (or information derived from it) or known matter forms part of the common general knowledge in the field of endeavour to which this specification relates.

As used herein, the term "set" corresponds to or is defined as a non-empty finite organization of elements that mathematically exhibits a cardinality of at least 1 (i.e., a set as defined herein can correspond to a unit, singlet, or single element set, or a multiple element set), in accordance with known mathematical definitions (for instance, in a manner corresponding to that described in An Introduction to Mathematical Reasoning: Numbers, Sets, and Functions, "Chapter 11: Properties of Finite Sets" (e.g., as indicated on p. 140), by Peter J. Eccles, Cambridge University Press (1998)). Thus, a set includes at least one element. In general, an element of a set can include or be one or more portions of a system, an apparatus, a device, a structure, an object, a process, a physical parameter, or a value depending upon the type of set under consideration.

The FIGS. included herewith show aspects of non-limiting representative embodiments in accordance with the present disclosure, and features or elements shown in the FIGS. may not be shown to scale or precisely to scale relative to each other. The depiction of a given element or consideration or use of a particular element number in a particular FIG. or a reference thereto in corresponding descriptive material can encompass the same, an equivalent, an analogous, categorically analogous, or similar element or element number identified in another FIG. or descriptive material associated therewith. The presence of "/" in a FIG. or text herein is understood to mean "and/or" unless otherwise indicated.

BRIEF DESCRIPTION OF THE DRAWINGS

Embodiments of the invention are illustrated in the accompanying non-limiting drawings in which.

DETAILED DESCRIPTION

The present invention involves drilling of blastholes and loading of blastholes with explosives charges and stemming material in a single event, sequence, stage, or cycle. Blastholes are drilled from the surface or top of a desired or target mining horizon to or approximately to the base or bottom of the desired or target mining horizon within a rock formation under consideration. The explosives charges and stemming material are then introduced or loaded in the blastholes to provide multiple blasting decks within and across the rock formation. The blasting decks divide the rock formation into rock volumes/regions that will be selectively blasted in a stage-wise approach, i.e., as independent blasting events. For any given blasting deck, the blast corresponding thereto will break rock in the immediate vicinity of the relevant explosives charges, and the broken rock is then excavated. The explosive charges in the next blasting deck may then be initiated, detonated, or fired, after which the broken rock generated by this firing may be subsequently excavated, and so on for consecutively deeper blasting decks.

Key differences between the present invention and the conventional approach can be explained with reference to FIGS. 1-5.

Figure 1:
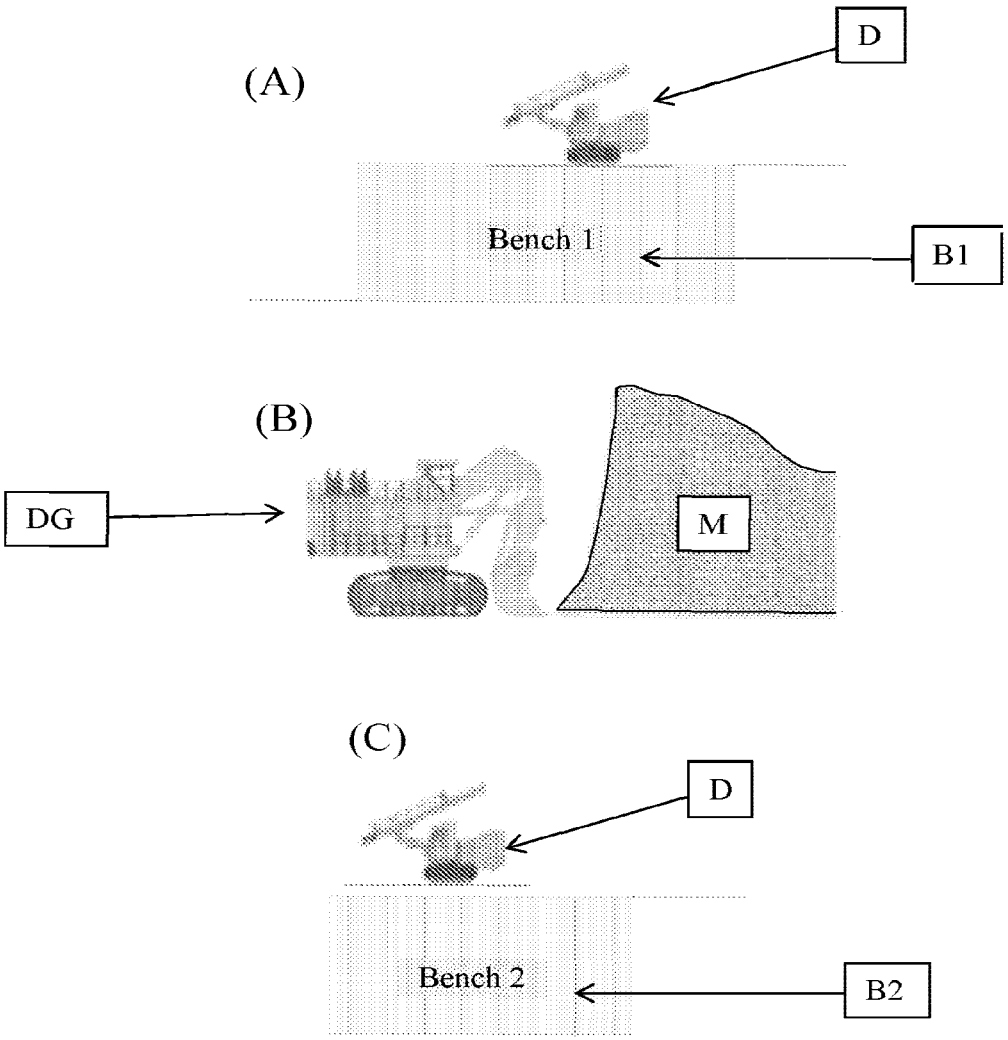
FIGURE 1 (PRIOR ART)
FIG. 1 is a schematic illustrating the steps associated with conventional open cut mining technique, with FIG. 1 providing FIGS. 1A-1C.

FIG. 1 depicts a conventional open cut mining technique in a rock formation. This involves a repeated cycling of steps, as follows:

First blastholes (B1) are drilled, charged with explosives and blasted. FIG. 1A shows drilling of blastholes in a bench of rock (Bench 1) using mobile drilling equipment (D). The blastholes are drilled to a particular blasting horizon or bench depth that corresponds to or defines the depth of rock that is to be blasted per cycle, which is an incomplete portion of a desired or target overall or complete mining horizon that will span multiple benches. The firing of explosives in the first blastholes (B1) of Bench 1 produces a muckpile of broken rock (M) and this is excavated from the area using a digger (DG; see FIG. 1B). This excavation reveals the upper surface of a new or next Bench 2, into which blastholes were not previously drilled. New or second blastholes (B2) are then drilled to or approximately to the depth of Bench 2 (see FIG. 1C) and charged with explosives and blasted, after which the muckpile generated by the firing of explosives of Bench 2 is excavated, etc. By following this conventional approach, an open cut mine rock formation will have blastholes cyclically drilled therein multiple times, where the blastholes drilled in any given drilling cycle are drilled to or approximately to the length or depth of the uppermost bench under consideration prior to being loaded with explosive charges corresponding to this uppermost bench. A separate blasthole drilling cycle occurs for each new or next bench after the new or next bench is exposed during open cut mine development. Thus, in accordance with this conventional open cut mining technique, mining a rock formation across the entire depth of a desired mining horizon by way of benches 1 . . . N, where N is greater than or equal to 2, requires N separate blasthole drilling and loading events, sequences, stages, or cycles.

With respect to FIG. 2, the method of the present invention involves drilling blastholes in a rock formation and loading the blastholes with multiple layers of selectively detonatable explosive charges separated from each other by inert stemming in a single event, sequence, stage, or cycle.

This single event can be defined as a single blasthole drilling and loading event, which can be defined to occur during a single blasthole pattern drilling and loading period within which multiple blastholes are drilled in the rock formation and each blasthole is loaded with multiple layers of explosives charges separated by inert stemming (e.g., one or more types of stemming material) to produce multiple blasting decks at different depths along the blastholes within the rock formation.

Figure 2A:
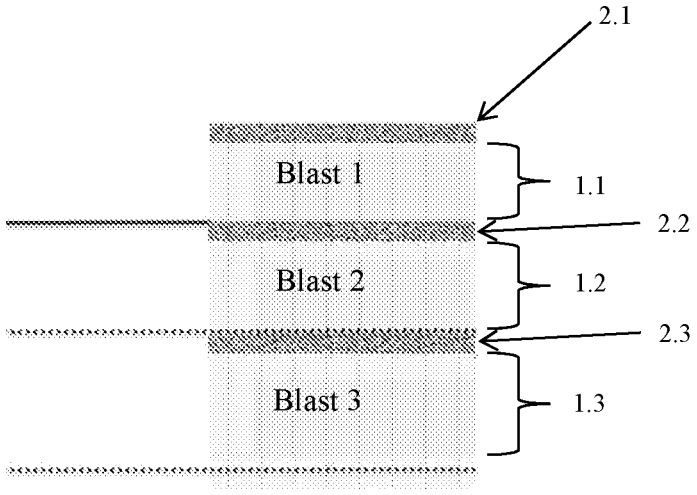
FIGS. 2-5 are schematics illustrating an open cut mining method in accordance with the present invention, with FIG. 2 providing FIGS. 2A-2D.

More particularly, FIG. 2A illustrates blastholes that have been drilled such that their lengths extend from an exposed surface or top to the base or bottom of the desired or target strata or mining horizon currently under consideration within the rock formation. The blastholes are loaded along the depth of the desired mining horizon with alternating layers of explosive charges and one or more types of stemming material, starting from the bottom of the blastholes to provide a series of blasting decks 1.1-1.3 and stemming decks 2.1-2.3, with a stemming deck 2.1 at an uppermost or top blasthole position. The blasting decks 1.1-1.3 are decks, segments, or portions of blastholes loaded with explosives charges, and the stemming decks 2.1-2.3 are decks, segments, or portions of blastholes loaded with inert stemming.

The representative example of FIG. 2 considers a total of 3 blasting decks, i.e., a first through a third blasting deck 1.1-1.3, and three stemming decks 2, i.e., a first through a third stemming deck 2.1-2.3, each of which resides across the top of its corresponding blasting deck 1.1-1.3. For any given blasting deck, the explosives charges carried by the blastholes of that blasting deck provide or define blasting regions, sites, or locations within the blasting deck. The initiation, detonation, or firing of the explosives charges in the blastholes of a given blasting deck causes a corresponding blast, which breaks the rock within the blasting deck. Thus, as shown in FIG. 2A, Blast 1 is designed or intended to break the rock within the first blasting deck 1.1; Blast 2 is designed or intended to break the rock within the second blasting deck 1.2; and Blast 3 is designed or intended to break the rock within the third blasting deck 1.3. The second and third stemming decks 2.2, 2.3 are intended to ensure that Blast 1 (in the first blasting deck 1.1) and Blast 2 (in the second blasting deck 1.2) do not adversely affect or damage the planned blasting horizons of the second and third blasting decks 1.2, 1.3, respectively.

The explosives charges of each of Blasts 1, 2, and 3, respectively corresponding to the first, second, and third blasting decks 1.1, 1.2, and 1.3, are loaded and thus prepositioned in-hole (i.e., along the depth of each blasthole) prior to the initiation of any of such explosives charges. Consequently, before the initiation of any of the explosives charges of Blasts 1, 2, and 3, the first blasting deck 1.1 is the uppermost blasting deck, which has been loaded with explosives charges corresponding to Blast 1; the second blasting deck 1.2 is below blasting deck 1, and has been loaded with explosives charges corresponding to Blast 2; and the third blasting deck 1.3 is the lowermost or bottom blasting deck, which has been loaded with explosives charges corresponding to Blast 3.

Figure 2B:
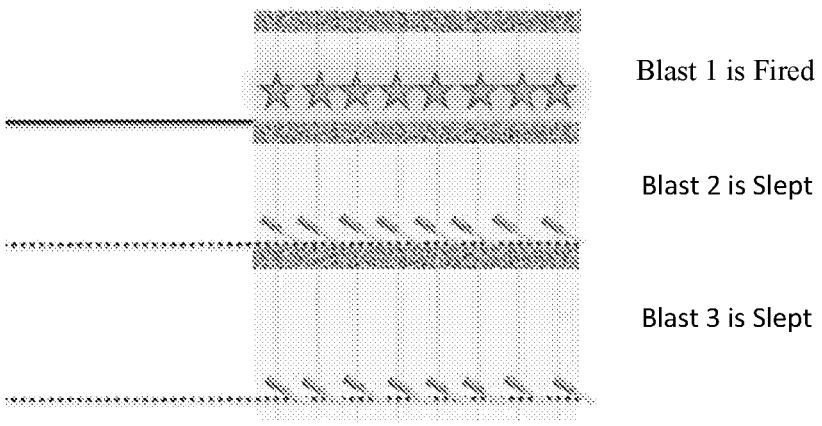
Figure 2C:
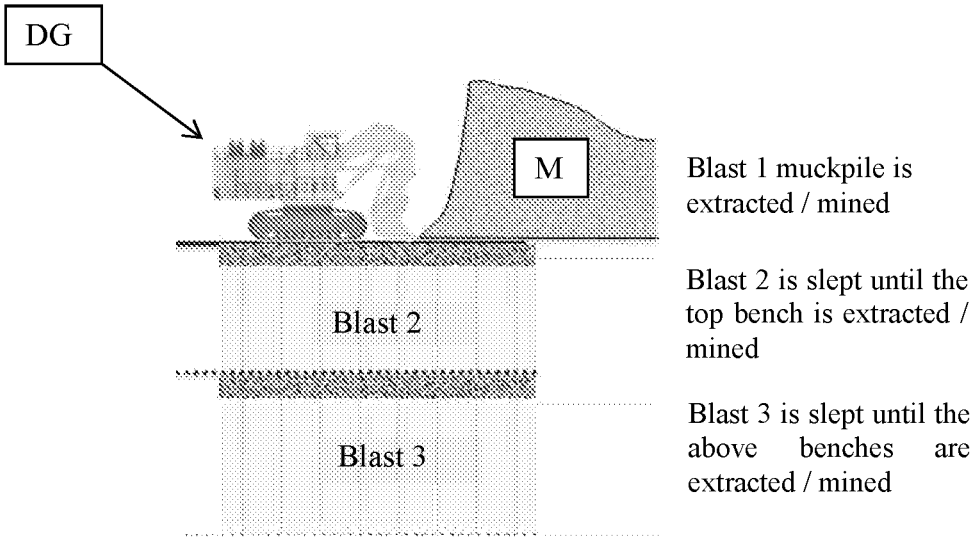
Figure 2D:
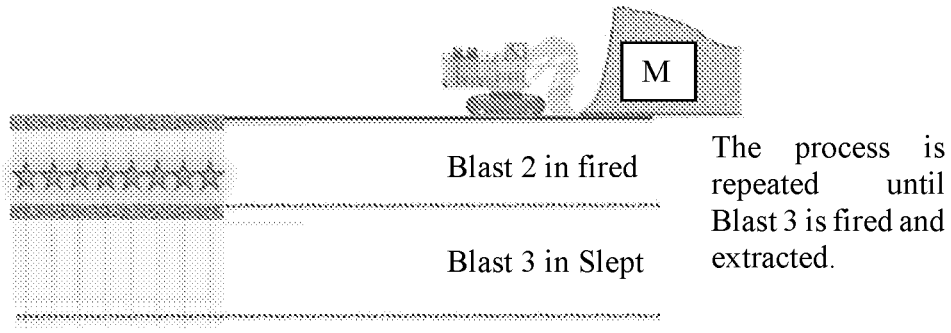

After the first, second, and third blasting decks 1.1-1.3 have been formed by way of drilling the boreholes and loading with explosive charges corresponding to each of the first, second, and third blasting decks 1.1-1.3 in these boreholes, the explosives charges corresponding to a given blasting deck can be selectively initiated separately from the explosives charges in each other blasting deck. More particularly, the explosives charges corresponding to Blasts 1, 2, and 3 can be selectively initiated in a sequential manner based on blasting deck position, proceeding consecutively from the first blasting deck 1.1 located across a top region or portion of the blastholes to the third blasting deck 1.3 located across a bottom region or portion of the blastholes. FIG. 2B shows Blast 1 being fired, with Blasts 2 and 3 being slept for the time being. After Blast 1 has been fired, the broken rock produced by that blast is excavated and removed (see FIG. 2C). After such broken rock has been removed, the explosives charges in Blast 2, which have already been pre-positioned in-hole since no blasthole drilling and loading for Blast 2 subsequent to the firing of Blast 1 occurs or is required, reside in the uppermost blasting deck 1.2 and are ready to be fired. The explosives charges in Blast 2 are subsequently fired (FIG. 2D), after which broken rock generated by Blast 2 is excavated, while Blast 3 is slept. After broken rock generated by Blast 2 has been excavated and the explosives charges in Blast 3 reside in the uppermost blasting deck 1.3, the explosives charges in Blast 3 are ready to be fired, without additional drilling and loading following the firing of the Blast 2 explosives charges because the Blast 3 explosives charges were already positioned in-hole prior to the initiation of Blasts 1 and 2.

Individuals having ordinary skill in the art will recognize that in general, the method of the present invention is applicable to blastholes containing Q blasting decks formed across the area and into depth of the desired or target mining horizon, where Q is greater than or equal to 2. More particularly, for a number of stacked or overlapping (e.g., on a vertical basis) blasting decks 1 . . . Q spanning the area and depth of the desired or target mining horizon, with blasting deck 1 being the outermost, uppermost, or top blasting deck and blasting deck Q being the lowest or deepest blasting deck, as part of the single blasthole drilling and loading event (e.g., during a single blasthole drilling event that occurs as part of the single blasthole drilling and loading event), blastholes are drilled from the top of the desired or target mining horizon to or approximately to the bottom of the desired or target mining horizon. Such drilled blastholes are loaded with multiple layers of selectively initiatable explosives charges separated by inert stemming (e.g., during a single blasthole loading event that occurs as part of the single blasthole drilling and loading event) to form blasting decks 1 . . . Q, prior to the blasting of any of blasting decks 1 . . . Q. After the formation of blasting decks 1 . . . Q, individual blasting decks can be consecutively blasted and excavated, from blasting deck 1, which resides at or across an outermost, uppermost, or top region of the desired or target mining horizon, to blasting deck Q, which resides at or across an innermost, lowermost, or bottom region of the desired or target mining horizon.

It will be clear from this that the method of the invention involves the drilling of blastholes and explosives loading of these blastholes in a single blasthole drilling and loading event, sequence, stage, or cycle; followed by multiple separate explosives charge initiation or firing and excavation events, sequences, stages, or cycles, where each initiation or firing gives rise to the blasting of a current outermost or uppermost blasting deck, and each excavation corresponds to the removal of broken rock produced by the blasting of this outermost or uppermost blasting deck. The fact that the invention allows the formation of multiple stacked blasting decks 1 . . . Q by way of blasthole drilling and explosives loading undertaken in a single event prior to the blasting of any of blasting decks 1 . . . Q is a significant advantage over the conventional approach discussed above. Individuals having ordinary skill in the relevant art will readily understand that not all blasting decks 1 . . . Q need to be of the same length or depth, but rather different blasting decks can have different lengths or depths, e.g., depending upon the rock formation and/or the distribution of recoverable material therein.

Figure 3:
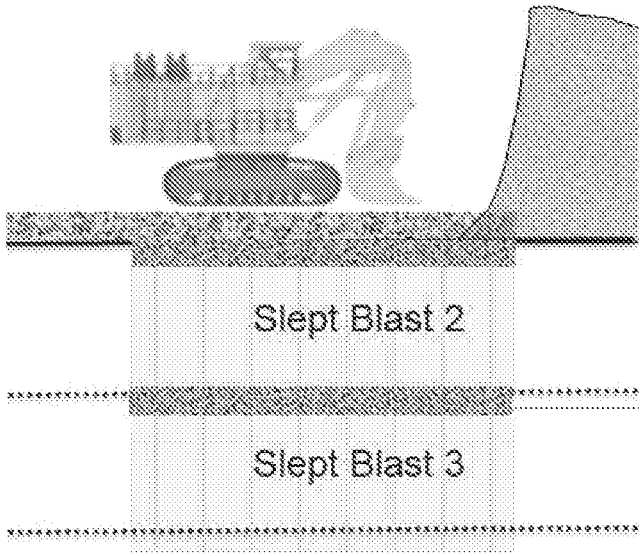

In the invention after a given blasting deck has been fired, broken rock resulting from such firing is excavated and removed. In an embodiment it may be desirable to retain a portion of the broken rock produced by the firing of a particular blast, and to arrange it as a layer over the top of the next blasting deck to be initiated to provide a false floor there above. This may be useful as it avoids disruption of stemming material at the top of blastholes in the next blasting deck to be initiated. Creation of a false floor may also provide a more robust surface upon which an excavator/digger and/or other equipment may move. In this embodiment, the depth of stemming material in the blastholes of the next blasting deck can be reduced to take into account the broken rock making up the false floor over the top of the blastholes. This embodiment is illustrated in FIG. 3, which shows a layer of broken rock left over the mining bench to create a false floor. The stemming material of the adjacent blasting deck is undisturbed.

The fact that the method of the invention involves a single drilling stage of multiple (e.g., relatively long, long, or very long) blastholes means that larger scale, automated equipment may be more efficiently or more productively used compared to the aforementioned conventional open cut mining technique. Typically, in accordance with the method of the invention, the blasthole diameter may be 76-200 mm and the blasthole length may be 25-30 m and possibly longer or much longer. For instance, it may be possible to drill to depths of 80 m or more. Contrast this with the conventional approach where multiple drilling stages of relatively short, small diameter blastholes is generally undertaken.

Moreover, the invention increases drilling efficiency due to reduced drill repositioning/relocation time, e.g., per blasthole. The invention also increases mine access and planning flexibility by allowing more rapid and/or less interrupted access to mine infrastructure (e.g. mine site haul roads and access ramps), which in accordance with the conventional approach mentioned above would otherwise be temporarily blocked or closed during each of multiple separate cycles or iterations of blasthole drilling and loading that would occur on a rock layer by rock layer or bench-by-bench basis across the depth of multiple layers of rock under consideration.

In an embodiment of the invention, the method may be applied for mining of recoverable material. The expression "recoverable material" encompasses coal, metal ores, and/or other material(s) having a value or use that makes recovery desirable during an open cut mining operation. In this embodiment, the method comprises recovering or removing recoverable material after at least one stage of initiating explosives charges. The recoverable material may be recovered using an excavator/digger. In such a case, waste material or rock (overburden and interburden) provided over a deposit, seam, or vein of recoverable material may be fragmented in accordance with the invention, thereby allowing the recoverable material to be accessed and recovered. The waste may be removed in one or more layers, each layer corresponding to a blasting deck in accordance with the method of the invention.

Figure 4:
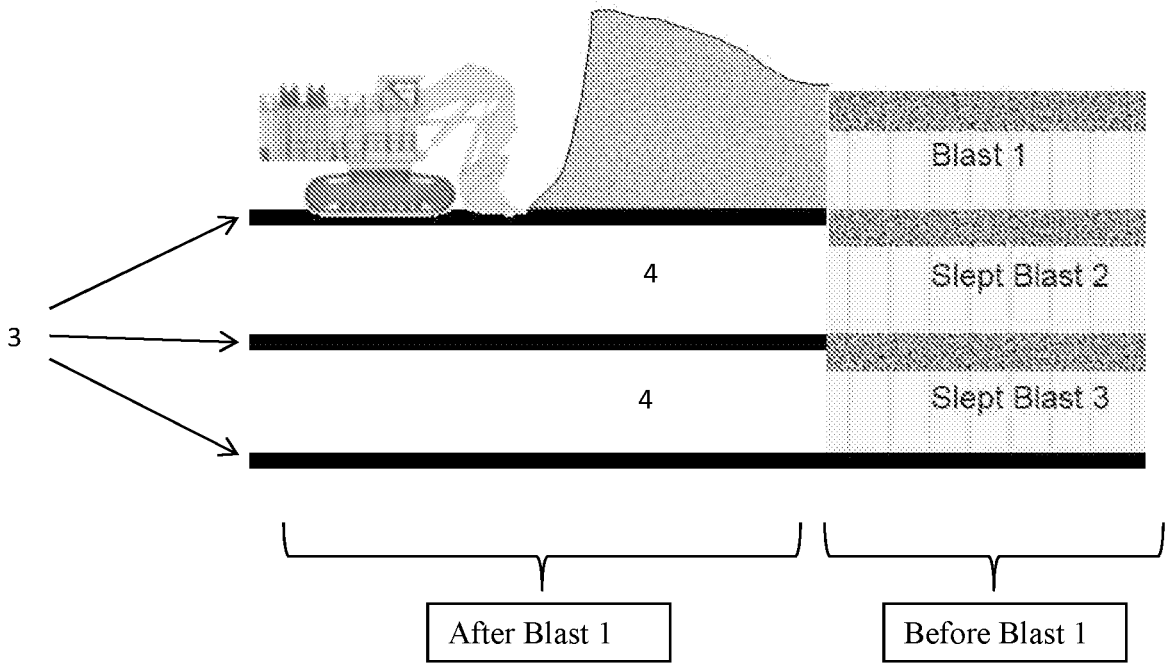

This embodiment may be illustrated with reference to FIG. 4. This figure shows three coal seams (3) extending horizontally or approximately horizontally with a layer of waste rock (rock; 4) initially present over each seam. In accordance with the invention a series of blastholes are drilled extending from an exposed rock or ground surface to the upper boundary or surface of the lowest or a target lowest coal seam. The blastholes are loaded with explosives charges and stemming material, such that each blasthole contains multiple layers of explosives charges separated by stemming material, with a layer of stemming material at the top of each blasthole. This blasthole drilling and loading is done in a single cycle and divides the formation into three blasting decks, which will be separately blasted by three corresponding blasts denoted Blast 1, Blast 2, and Blast 3. The right hand side of FIG. 4 shows the decks before initiating Blast 1. The left hand side of FIG. 4 shows the decks after initiating Blast 1.

The initiation or firing of Blast 1 provides a muckpile of broken rock. Blasts 2 and 3 are slept at this point. The upper coal seam remains intact. The muckpile can then be excavated and removed using a digger. The upper coal seam then becomes the digging horizon from which coal can be removed. After the upper coal seam has been mined, the layer of waste over the next coal seam can be blasted by initiation of Blast 2, and excavated. This allows the next coal seam to be exposed and mined. This blasting and digging cycle is repeated, thereby allowing each coal seam to be accessed and mined sequentially. The decking corresponding to Blasts 2 and 3 may protect deeper portions of the coal seam from the effect(s) of Blast 1, and so on.

Implementation of this through-seam approach requires a geological understanding of the rock formation and the dimensions and orientation of the seams of recoverable material. It is preferable to avoid placing explosives charges in regions of blastholes that extend through the recoverable material as this will result in unnecessary or excessive damage of the recoverable material and dilution of the recoverable material with waste rock (muckpile). More particularly, stemming material can be loaded into the blastholes in those regions of the blastholes that extend through the recoverable material. Suitable positioning of the blastholes, explosives charges, and stemming material may minimize damage and dilution of the recoverable material, in a manner readily understood by individuals having ordinary skill in the relevant art.

Figure 5:
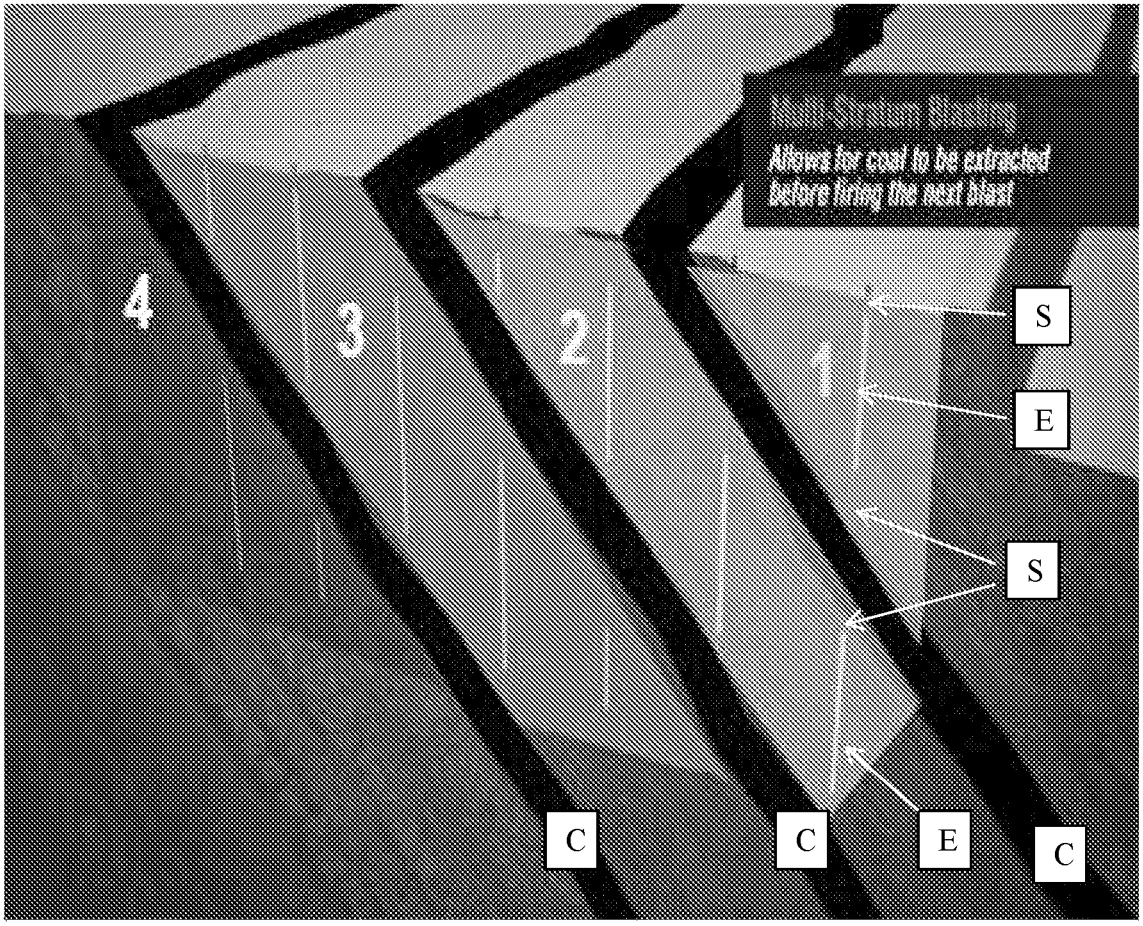

In another embodiment, the invention may be applied to access recoverable material in deposits, seams, or veins that are not horizontally or approximately horizontally extending (e.g., which exhibit a significant or strong downward dip or slope). This embodiment is illustrated in FIG. 5, which shows 3 coal seams (C) in sectional view, extending downwardly away from an exposed surface in a diagonal arrangement. Blastholes (a total of 7 rows of blastholes are shown in the Figure) are drilled through the coal seams. Each row of blastholes is loaded with explosives charges (E) and stemming material (S). Note that in this representative example, explosives charges (E) are not provided in regions of the blastholes that intersect the coal seams (C). Rather, these regions include stemming material (S). Thus, stemming material (S) can be pre-positioned on the upper and lower sides of any given coal seam (C), e.g., across or on opposite sides of each coal seam (C) that a blasthole intersects, separating the coal seam (C) from direct contact with the explosives charges (E) in the blastholes. The intention is to minimize damage to the coal seams (C) when blasting takes place. The bench is then blasted in sections above each coal seam (C). In the figure, the sections are denoted 1, 2, 3, and 4. Section 1 is blasted first, then section 2, then section 3 and then section 4. Broken rock resulting from the blasting of any given Section is excavated prior to the blasting of the next Section. In this way each coal seam (C) can be accessed sequentially. The invention offers great flexibility with respect to blast depth and how individual explosives charges or groups of explosives charges within an array of blastholes are selectively initiated.

The invention requires loading of blastholes with a plurality of explosive charges and controlled selective initiation of those charges. Herein reference to loading blastholes with explosive charges means that blastholes are loaded with explosive formulations (e.g., one or more types of explosive compositions) and selectively controllable initiation devices or systems that can initiate the explosive formulations. In accordance with the invention, some explosive charges within the same and different blastholes are selectively slept, while other explosives charges in the same and different blastholes are fired. In view of the foregoing, for blastholes having multiple selectively initiable layers of explosives charges therein corresponding to a plurality of benches that extend to or across a desired or target mining horizon within a rock formation, explosives charges in those (lower or deeper) portions of the blastholes corresponding to each bench below a current uppermost, top, or outermost level bench are intentionally slept such that the blasting of any given bench below or under the current top level bench does not occur until after other explosives charges residing in those (upper) portions of blastholes corresponding to the current top level bench have been fired and the broken rock produced thereby has been excavated.

The initiation devices or systems used will need to remain operational and unaffected by prior initiation of explosives charges in the same blasthole and in other blastholes. This precludes the use of wired initiation systems that rely on wiring or cables for communication of command signals, at the very least in blasting decks below the uppermost, top, or outermost blasting deck (i.e., blasting decks 2 . . . Q, where blasting deck 1 is the top blasting deck). Such cables will be damaged or destroyed by blasts within the same blasthole and/or in adjacent blastholes. This issue may be addressed in accordance with the present invention using a wireless electronic blasting system (WEBS) to initiate explosives charges.

The WEBS is an electronic initiation system suitable for initiation of explosive charges. When loaded in a blasthole, the WEBS is powered by an in-hole energy source or supply, for instance, a WEBS-internal (on-board) energy supply (e.g., a battery and/or capacitor). The WEBS receives command instructions wirelessly, for example, in an embodiment by way of very low frequency magnetic resonance signals that can be transmitted through rock, air and/or water. The WEBS does not rely on any physical (wired) connections to an external power supply or physical (wired) connections to a blasting machine for exchange of communication signals necessary for functionality. In the context of the present invention, this means that WEBS in successive blasting decks will not be affected or damaged by blasts in preceding blasting decks, and communication channels to each WEBS will remain intact. The WEBS may also be programmable with respect to WEBS identity and/or detonation delay times and this will enhance implementation of the invention as will be discussed. In various embodiments, WEBS are deployed or used in each blasting deck along the length or depth of the boreholes. However, in an embodiment, initiation devices having wire-based couplings or connections can be used in the top blasting deck, while WEBS are deployed in each blasting deck below the top blasting deck.

Suitable WEBS for use in the present invention are known and described for example in Applicant's own published International Patent Publication No. WO 2015/143501 and International Patent Publication No. WO 2015/143502, the contents of which are incorporated herein by reference. Suitable WEBSs are also commercially available from Orica.

The length or depth of rock blasted in each blasting deck may vary depending upon such things as:

- the geological and geotechnical conditions
- the blasthole design (density and pattern of holes, burden and relief)
- the initiation sequence
- the type/types of explosive(s), and energy/energies thereof
- restrictions on blast induced ground vibration and/or noise To achieve suitable initiation control of explosives formulations, the WEBSs in the same blasting deck may be allocated a unique group identifier or identification that ensures that only wireless commands intended for those WEBSs are actioned. This approach allows each of the WEBS being used to be programmed before deployment, on deployment, or while deployed in a blasthole to enhance effectiveness and efficiency of operation. This approach also allows a specific (predetermined or programmably defined) group of WEBSs to be detonated in a desired sequence, while other pre-programmed WEBSs do not initiate. Rather, those WEBSs can remain asleep in the blastholes until they are commanded by a suitably coded signal to wake up and detonate. The use of group identification features to ensure that command signals are actioned by a predetermined or programmably selected group of wireless devices is the subject of WO 2010/085837, the contents of which are incorporated herein by reference.

The explosives formulations used will be of known composition and will be selected based on their suitability. Typically, the explosive formulation will include or be an emulsion explosive formulation.

The invention claimed is:

1. A method of mining in a rock formation, comprising:

drilling blastholes extending into the rock formation, each of the blastholes having a depth between a first end and a second end, wherein for each blasthole the second end thereof is deeper into the rock formation than the first end thereof;

loading the blastholes with alternating layers of explosives charges and stemming material to establish a succession of blasting decks or sections extending across and within the rock formation including a first blasting deck or section and at least a second blasting deck or section, wherein each blasting deck or section beyond the first blasting deck or section extends deeper into the rock formation than the first blasting deck or section; and after establishing the multiple blasting decks or sections extending across and within the rock formation, selectively initiating the explosives charges in a series of stages based on blasting deck or section proceeding consecutively from the first blasting deck or section to each successive blasting deck or section;

wherein during initiating the explosives charges in a given blasting deck or section, the explosive charges in each deck or section successive to the given blasting deck or section are slept while broken rock produced by the given blasting deck or section is excavated; and wherein after each stage excavation takes place to progress mining in an intended direction; and wherein excavation corresponding to at least one stage comprises retaining a portion of broken rock produced following the initiation of a given blasting deck to arrange the portion of broken rock over a next successive blasting deck to provide above the next successive blasting deck a false floor that withstands movement of excavation equipment.

2. The method of claim 1, wherein the explosives charges in each blasting deck or section comprise a set of explosive formulations and a set of selectively controllable initiation devices that can initiate the set of explosive formulations in the blasting deck or section.

3. The method of claim 2, wherein the set of initiation devices in each blasting deck or section is a set of wireless initiation devices.

4. The method of claim 2, wherein the set of initiation devices in each blasting deck or section other than the first blasting deck or section is a set of wireless initiation devices.

5. The method of claim 1, A method of mining in a rock formation, comprising:

drilling blastholes extending into the rock formation, each of the blastholes having a depth between a first end and a second end, wherein for each blasthole the second end thereof is deeper into the rock formation than the first end thereof;

loading the blastholes with alternating layers of explosives charges and stemming material to establish a succession of blasting decks or sections extending across and within the rock formation including a first blasting deck or section and at least a second blasting deck or section, wherein each blasting deck or section beyond the first blasting deck or section extends deeper into the rock formation than the first blasting deck or section; and after establishing the multiple blasting decks or sections extending across and within the rock formation, selectively initiating the explosives charges in a series of stages based on blasting deck or section proceeding consecutively from the first blasting deck or section to each successive blasting deck or section;

wherein during initiating the explosives charges in a given blasting deck or section, the explosive charges in each deck or section successive to the given blasting deck or section are slept while broken rock produced by the given blasting deck or section is excavated;

wherein after each stage excavation takes place to progress mining in an intended direction;

wherein the succession of blasting sections comprises a plurality of blasting sections that are separated from each other by recoverable material comprising a portion of a mineral deposit, seam, or vein; and wherein each blasting section corresponds to waste rock.

6. The method of claim 5, wherein the blastholes extending across and within the succession of blasting sections intercept and extend through at least one mineral deposit, seam, or vein, and wherein within each blasthole stemming material is disposed on opposite sides of each mineral deposit, seam, or vein that each blasthole intercepts, separating the mineral deposit, seam, or vein from direct contact with the explosives charges in the blasthole.

7. The method of claim 6, wherein each mineral seam comprises a coal seam.

8. The method of claim 5, wherein each mineral seam comprises a coal seam.

* * * * *